United States Patent [19]

Smith

[11] Patent Number: 4,584,082

[45] Date of Patent: Apr. 22, 1986

[54] METHOD AND APPARATUS FOR ACID MIST REDUCTION

[76] Inventor: James W. Smith, 33 Airdire Rd., Toronto, Ontario, Canada, M4G 1L8

[21] Appl. No.: 659,525

[22] Filed: Oct. 10, 1984

[30] Foreign Application Priority Data

Oct. 12, 1983 [GB] United Kingdom ..... 8327300

[51] Int. Cl.[4] ..... C25B 9/00

[52] U.S. Cl. ..... 204/278; 204/129; 204/297 R; 204/297 W; 204/270; 204/289

[58] Field of Search ..... 204/278, 286, 270, 129, 204/128, 266, 256–258, 297 R

[56] References Cited

U.S. PATENT DOCUMENTS

| | | | |
|---|---|---|---|
| 3,790,465 | 2/1974 | Giacopelli et al. | 204/266 |
| 3,875,041 | 4/1975 | Harvey et al. | 204/277 |
| 3,930,151 | 12/1975 | Shibata et al. | 204/266 |

*Primary Examiner*—R. L. Andrews

*Attorney, Agent, or Firm*—Sim & McBurney

[57] ABSTRACT

Bubbles produced at an electrode in an electrolytic process are coalesced by providing a surface-limiting, electrically inert masking device of which at least a bottom portion is submerged in the electrolyte. The masking device reduces the free surface of the electrolyte between the electrodes and this urges the gas bubbles together so that they coalesce, resulting in larger bubbles and less acid mist generation.

6 Claims, 7 Drawing Figures

METHOD AND APPARATUS FOR ACID MIST REDUCTION

This invention relates generally to a technique for reducing the amount of acid mist generated in the electro-winning or electro-refining of many metals, such as zinc.

BACKGROUND OF THIS INVENTION

During the electro-winning or electro-refining of many metals, oxygen gas may be released at the anode and hydrogen gas may be released at the cathode. Both phenomena reduce the current efficiency, since energy is diverted from production of the metal to production of gas.

The gas is released initially as fine bubbles along the face of the electrodes, and the bubbles rise to the electrolyte surface where they discharge to the atmosphere. This process produces an aerosol mist above the cells with the smaller bubbles imparting more energy to the acid droplets formed when the bubbles burst at the electrolyte surface. This in turn poses a major health hazard to the process operators as well as a corrosion problem for the equipment and the building.

Certain attempts in the past to come to grips with this problem have included installing ventilation systems, plastic screens or sheets provided around the electrodes, covers over the tanks, balls, electrode hoods, and the use of surface active agents in the electrolyte. All of these prior methods involve high maintenance costs and high installation costs, and some involve an increased energy consumption.

GENERAL DESCRIPTION OF THIS INVENTION

We have found that for the same volume of gas produced, the larger the bubbles, the less is the quantity of acid mist generated. One aspect of the present invention, accordingly, is to provide a technique for coalescing the fine bubbles produced at the electrodes into larger ones, so that only the larger ones arrive and burst at the electrolyte surface.

This aim can be accomplished by deliberately narrowing the channel through which the bubbles must pass at the top of the inter-electrode space to arrive at the electrolyte surface. Mbre specifically, this invention, in one apsect, provides a plurality of shaped clips fastened to the tops of either one or both of the vertically oriented electrodes, and running the full width of the electrodes.

More particularly, this invention provides a method of coalescing bubbles produced at an electrode in an electrolytic process in which electrodes consisting of at least one anode and at least one cathode are adjacent but spaced from one another, and are substantially immersed in the electrolyte, the method comprising:

affixing to at least one electrode a surface-limiting electrically inert masking means of which at least the bottom portion is submerged in the electrolyte, the masking means extending over the whole upper portion of said one electrode and projecting above the surface of said electrolyte, thus reducing the free surface of the electrolyte between the electrodes, and passing current between the electrodes, thus generating gas bubbles at at least one electrode, the gas bubbles being urged together by the masking means and coalescing.

In another aspect, this invention provides an electrolysis apparatus in which bubbles of gas produced at an electrode immersed in an electrolyte may be coalesced in order to reduce acid mist generation, the apparatus including electrodes consisting of at least one anode and at least one cathode which are adjacent but spaced from one another, and are substantially immersed in the electrolyte, at least one electrode having affixed thereto a surface-limiting, electrically inert masking means of which at least the bottom portion is submerged in the electrolyte, the masking means extending over the whole upper portion of said one electrode and projecting above the surface of said electrolyte, thus reducing the free surface of the electrolyte between the electrodes, thus urging gas bubbles generated at one of the electrodes to coalesce together.

THE PRIOR ART

The prior art contains teachings involving the provision of deflector panels under the surface of an electrolyte and oriented with respect to the vertically situated electrodes so that bubble coalescence is improved. One such patent is U.S. Pat. No. 3,790,465, Giacopelli et al, issued Feb. 5, 1974. In this patent, deflector panels located in a diverging sense at the top of a hollow anode, but fully submerged beneath the surface of the electrolyte, are intended to cause the gas bubbles to undergo a coalescence, which accelerates their ascending movement. However, at the top edge of the oblique deflectors of U.S. Pat. No. 3,790,465, the electrolyte must pass around a sharp corner (the corner of the deflector), and this sudden introduction of a turbulent effect could serve to break the larger bubbles up again, creating smaller bubbles. This particular construction is therefore considered not conducive to reducing the production of a deleterious mist at the surface of the electrolyte.

U.S. Pat. No. 3,930,151, issued Dec. 30, 1975 to Shibata et al provides a plurality of oblique guiding plates between two adjacent electrodes, the purpose of which is to direct evolving chlorine gas toward the centre of the region between the electrodes. Again, the guiding plates do not extend to the surface of the electrolyte. The basic purpose of this prior art development is to remove the bubbles from the surfaces of the electrodes, and thus increase the efficiency of the electrolytic cell.

By contrast with the prior patents just described, I have now found that the provision of means, at the electrolyte surface between adjacent cells, for reducing the cross-sectional area through which rising bubbles must pass (the cross-sectional area being taken in a horizontal plane) not only promotes coalescence of bubbles and an increase in the mean bubble diameter, but allows the enlarged bubbles to maintain the larger size up to the surface of the electrolyte, where they burst and produce a minimum of acid mist generation.

GENERAL DESCRIPTION OF THE DRAWINGS

Five embodiments of this invention are illustrated in the accompanying drawings, in which like numerals denote like parts throughout the several views, and in which.

DETAILED DESCRIPTION OF THE DRAWINGS

Figure 1:
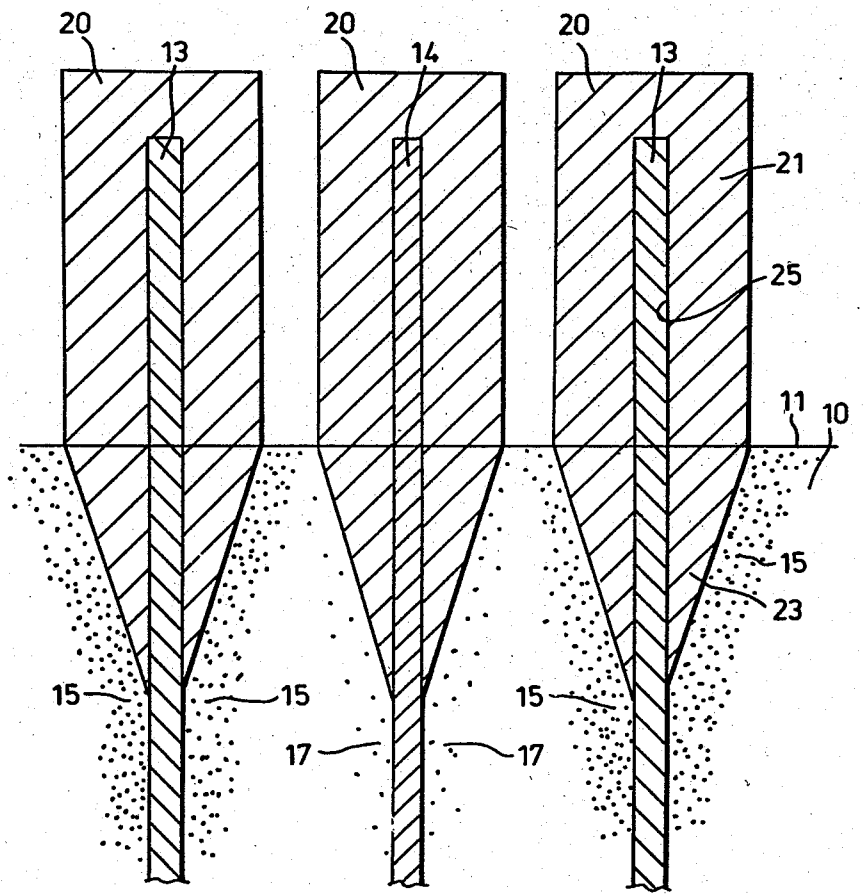
FIG. 1 is a partial vertical sectional view through a portion of an electrolytic cell, showing a first embodiment of the shaped clip of this invention in place.

Attention is first directed to FIG. 1, in which a liquid electrolyte 10 has a surface 11 through which project a plurality of vertical electrodes which are shown in the figure to include two anodes 13 and a cathode 14 between the anodes 13. As can be seen, gas bubbles 15 are generated on both sides of each anode, whereas gas bubbles 17 are generated on both sides of the cathode. Typically, oxygen gas is released at the anode, and hydrogen gas at the cathode. These bubbles, formed at the surfaces of the electrodes, float upwardly through substantially quiescent liquid at a velocity which is a function of the diameter of the bubbles. The bubbles also exert an air lift effect, whereby a rising electrolyte current tends to form close to each electrode surface.

The present invention turns part of the rising current energy into controlled turbulence which promotes collision between the bubbles and causes them to coalesce in a manner which may be similar to the mechanism of flocculation of solids suspended in a liquid.

Figure 2:
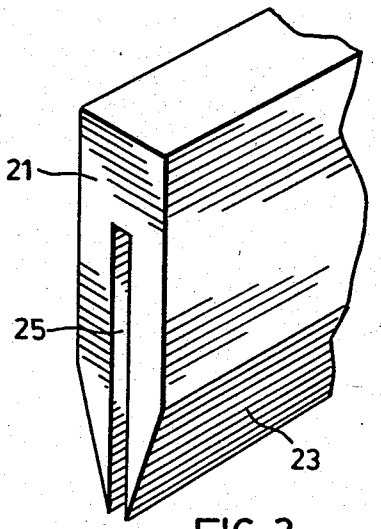
FIG. 2 is a partly broken-away isometric view of one of the shaped clips of FIG. 1.

More specifically, in the embodiment illustrated in FIGS. 1 and 2, this invention provides, for each electrode, a wedge-shaped clip 20 which, in vertical section, has a portion 21 of substantially rectangular configuration, and a tapering portion 23 constituting the wedge. An internal vertical slot 25 is provided for receiving the respective electrode.

As illustrated in the drawing of FIG. 1, the clips 20 alter both the direction of flow and the velocity of the bubbles as these move towards the surface of the electrolyte. This results in a higher degree of circulation of the gas bubbles in the electrolyte.

Thus, the bubbles which arrive and burst at the surface tend to be larger. Moreover, the presence of the clips reduces the exposed surface area of the electrolyte, and this results in an enhancement of foam formation.

It has been found that a reduction of the inter-electrode space to about 20 to 25% at the electrolyte surface accomplishes a substantial reduction in acid mist production.

Figure 3:
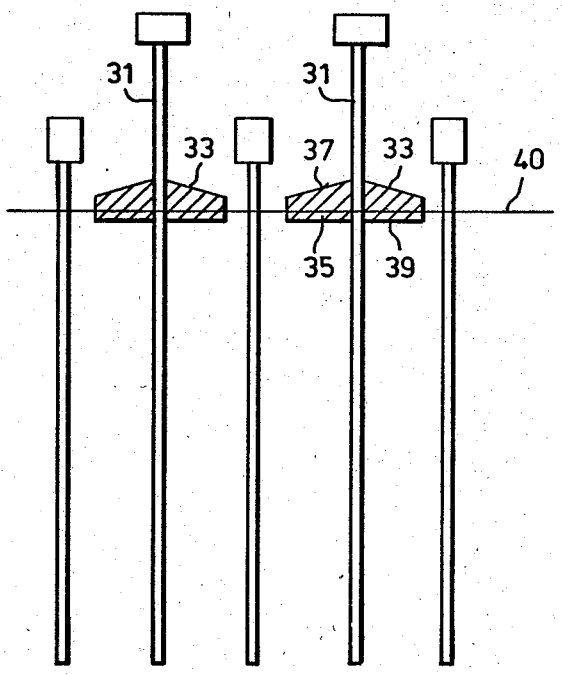
FIG. 3 is a view similar to FIG. 1, showing the second embodiment of the clip of this invention.

Attention is now directed to FIG. 3, in which the anodes 31 of a typical copper cell are provided with clips 33 having a rectangular lower portion 35, and a roof-shaped upper portion 37. The rectangular lower portion 35 exhibits a flat bottom surface 39 which, in the operation of the cell, lies just below the electrolyte level 40. In a copper cell, the cathode would not be provided with a clip. It can be seen in FIG. 3 that the electrolyte surface area through which bubbles can pass into the atmosphere is restricted by the presence of the clips 33.

Figure 4:
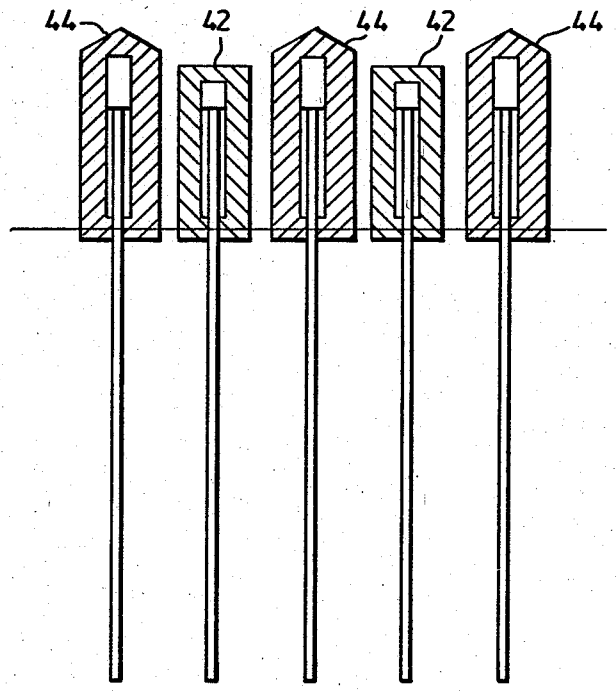
FIG. 4 is a view similar to FIG. 1, showing the third and fourth embodiments of the clip of this invention.

Attention is now directed to FIG. 4, which represents a typical zinc cell. In the zinc cell, the cathodes have clips 42 which are essentially rectangular in section, whereas the anodes have clips 44 which are rectangular in their lower portions, but have roof-shaped upper surfaces.

Again, the presence of the clips 42 and 44 reduces the electrolyte surface area through which bubbles can enter the atmosphere.

Figure 5:
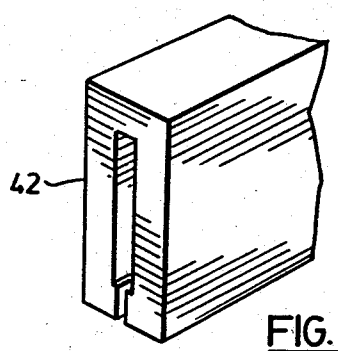
FIG. 5 is a partly broken-away isometric view of the third embodiment of the clip of this invention.

FIG. 5 illustrates an end of one of the clips 42.

Figure 7:
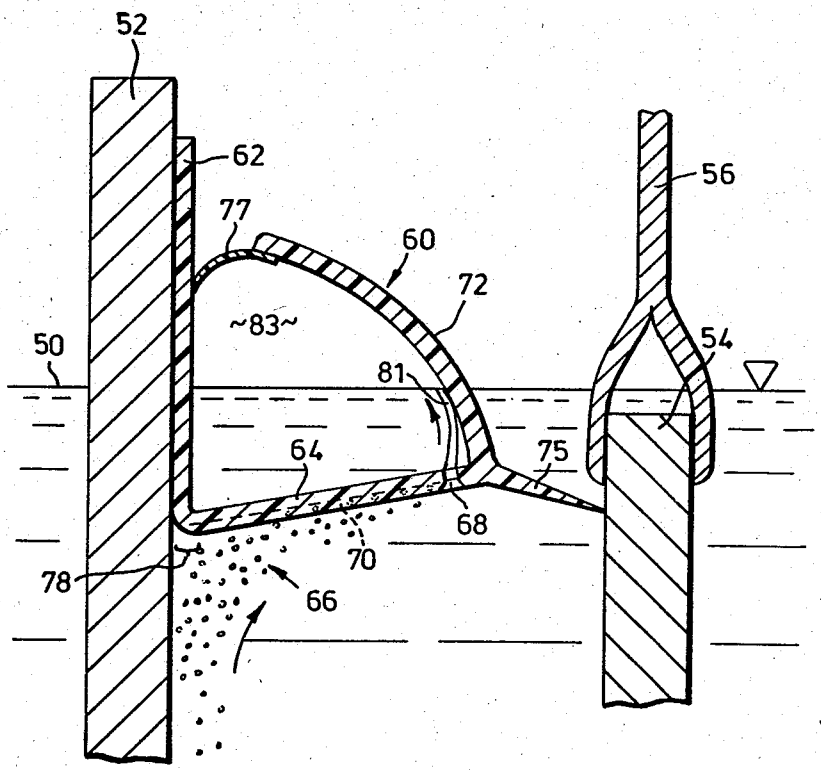
FIG. 7 is a vertical sectional view through a portion of an electrolytic cell, showing a fifth embodiment of this invention.

Attention is now directed to FIG. 7, which shows the fifth embodiment of this invention. In FIG. 7, an electrolyte surface is shown at 50, and into the electrolyte is partially immersed an anode 52. A cathode 54 is totally immersed in the electrolyte, and is supported by a strap 56. This is a typical arrangement for a copper cell. The reason for providing the strap 56 for the cathode 54 is to avoid corrosion of the copper cathode itself at the surface of the electrolyte. Corrosion tends to take place because of the availability of oxygen at the surface. Conventionally, by providing the strap 56, any corrosion takes place at the strap and not on the electrode 54. Further, by continuously and regularly varying the level of the electrolyte within the cell, the location at which corrosion is taking place on the strap 56 can be shifted up and down. Both the strap 56 and the cathode 54 are of copper, and beneath the surface 50 of the electrolyte metallic copper plates out onto the cathode. Thus, by submerging a previously corroded portion of the strap 56, metallic copper can be made to plate out at the corroded region, thus filling in the corroded or pitted area. It will be seen from what follows that one aspect of this invention is to reduce or eliminate the corrosion and pitting of the cathode strap in a copper cell or similar electrolytic process where pitting takes place at the electrolyte surface.

In FIG. 7, a masking device 60 is provided. The masking device 60 has a first arm member 62 which is adapted to be affixed against the electrode 52 in a substantially vertical orientation as shown. A second arm member 64 is attached to the first arm member 62 adjacent the bottom thereof, and extends away therefrom at an angle to the vertical. In the embodiment shown, the angle between the arm members 62 and 64 is slightly acute, with the second arm member 64 extending generally laterally away and slightly upwardly from the bottom of the first member 62.

The second arm member has aperture means through which the gas of bubbles 66 generated at the surface of the electrode 52 entrapped beneath the second arm member 64 can pass. More particularly, the aperture means includes a plurality of holes 68 along the edge of the second arm member 64 which is remote from the first arm member 62. The second arm member 64 has, for each hole 68, a groove 70 in its underside. Each groove 70 begins adjacent the first arm member 62 and terminates at its respective hole 68. Thus, the second arm member 64 has a plurality of parallel but spaced-apart grooves 70 in its underside.

The masking device 60 further includes a hood member 72 which is attached to the second arm member 64 on the side of the holes 68 which is remote from the first arm member 62. The hood member 72 extends generally upwardly and curvingly leftwardly toward the first arm member 62. It is preferably oriented in such a way that any bubbling upwardly from the holes 68 will encounter the inside sloping surface of the hood member 72, and thus be further induced to coalesce. Initial coalescing, of course, takes place in the grooves 70 and during passage through the holes 68.

In the embodiment shown in FIG. 7, the masking device 60 further includes a third arm member 75 projecting away from the bottom of the hood member 72 and generally away from the first arm member 62. In particular, the third arm member 75 slopes slightly downwardly as it projects in the direction away from the first arm member 62. The sizing of the masking device 60, including the third arm member 75, is such that the third arm member lightly contacts the adjacent cathode 54. An important result of this configuration is that little or no electrical current flows between the electrodes 52 and 54 above the general line defined by the second and third arm members 64 and 75. This means that little or no corrosion or pitting will take place on the strap 56, since corrosion requires both the presence of oxygen and a flow of current at the location of the corrosion. This eliminates the necessity for constantly varying the level of the electrolyte, which currently requires many man-hours to accomplish in large installations.

In the embodiment shown in FIG. 7, the hood member 72 has affixed to it a flexible member 77 spanning between the hood member 72 and the first arm member 62, thereby permitting collection of gaseous materials passing through the holes 68.

In a preferred embodiment, the elbow region at which the second arm member 64 is attached to the first arm member 62 is resiliently flexible. This region is identified by the numeral 78 in FIG. 7. Also, the third arm member 75 is preferably flexible with respect to the hood member 72 and the second arm member 64. More particularly, the provision of these flexible regions in an otherwise relatively rigid device like the masking device 60 can be accomplished through known technology during the extrusion of the section shown in FIG. 7. A plasticizing material is injected into the basic plastic stock in the region 78 and also in the region of the third arm member 75, thus rendering the elbow 78 and the third arm member 75 flexible. A typical plastic material for the masking device 60 is high density polypropylene, although high temperature PVC may also be utilized.

In FIG. 7 it can be seen that the small bubbles rising adjacent the right hand face of the electrode 52 enter the grooves 70 and gradually coalesce to larger bubbles, ultimately passing upwardly through the holes 68 and emerging therefrom typically as a stream 81 of gas. If bubbling takes place above the holes 68, the bubbles contact the inside surface of the hood member 72 and are again coalesced. The presence of the flexible member 77 permits entrapment of the upwardly escaping gas in the region 83, from which it can be ducted out or withdrawn under suction.

The flexible member 77 would also function to improve removal efficiency for the gases.

Typically, the holes 68 may be approximately ⅛ inch in diameter, and are countersunk from underneath.

EXAMPLES

Early experiments were carried out in a lab scale zinc electro-winning cell, duplicating an actual cell of an operating zinc producing company. The electrolyte was supplied by the company. Acid emission reductions in the test cell were measured at from 30% to as much as 95%. Generally, it was found that the reduction efficiency increased as the thickness of the wedges or clips increased, i.e. as the liquid surface open area was reduced.

It is considered important that the clips (masking devices) be installed at the surface of the electrolyte and extend down into the electrolyte. Varying the depth of penetration has showed little change in reduction efficiency.

As previously indicated, the clips or masking devices should be constructed of a material which is electrically non-conductive, such as a suitable plastic, and which is not attacked by the electrolyte or by the gases generated.

EXAMPLE 1 - Zinc Electrowinning

An experimental electrolytic zinc cell of commercial electrode spacing and depth, and consisting of a single cathode of aluminum and two anodes, of lead-silver alloy was used to electrolyse an electrolyte consisting of:

| | |
|---|---|
| Zn | 37.7 g/L |
| Mn | 4.1 g/L |
| Mg | 5.7 g/L |
| $H_2SO_4$ | 150 g/L |

The density was 1.23 g/mL. The current efficiency was 90% at a current density of 615 A/m$^2$ and a voltage drop of 3.5 v. An Andersen impactor was used to evaluate the total mist emitted at an air flow rate of 28.32 L/min, the mist collected being analyzed by conventional means. In the absence of coalescer units, (the clips or masking devices), the acid emission rate on stabilized electrodes which had been operated for some time was 1.30 mg/m$^2$.s, as measured 20 cm above the surface of the electrolyte. Rectangular control elements such as shown in FIG. 5 and covering 90% of the electrolyte surface were then applied, and they resulted in a reduction in acid emission to 0.08 mg/m$^2$.s, which is a reduction of 94% in acid emission.

EXAMPLE 2 - Copper Electrowinning

The commercial electrolysis cell described in Example 1 was modified by using anodes of 5% antimony in lead and a cathode of 1 mm copper sheet, with the same dimensions as in Example 1. The cathode was submerged about 0.5 cm below the surface of the electrolyte. The spent electrolyte was a copper sulfate solution of 30 g/L Cu and 150 g/L sulfuric acid. The neutral solution was copper sulfate with a copper concentration of 70 g/L. The current efficiency was 98–100% at a current density of 180 A/m$^2$. Without control elements, the emission rate was found to be 1.6 mg/m$^2$.s. With the control elements completely covering the electrolyte surface, as shown in the configuration of FIG. 7, the emission rate was reduced to less than 0.08 mg/m$^2$.s, indicating a control efficiency of better than 95%.

Figure 6:
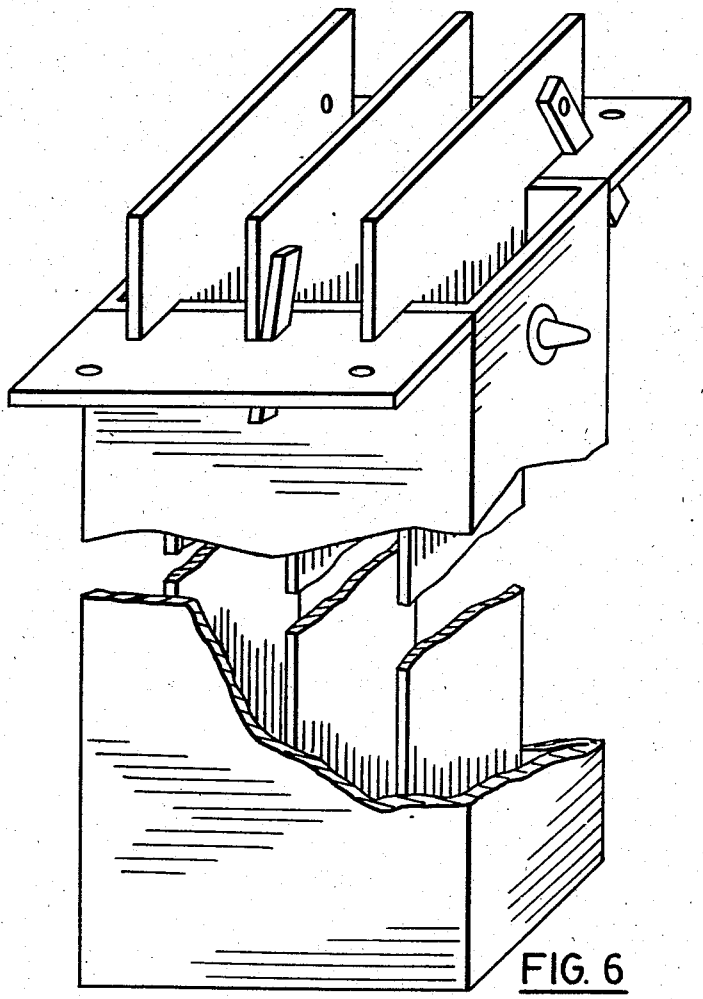
FIG. 6 is a partly broken-away view of an electrolytic cell used to obtain experimental data provided in this specification.

FIG. 6 is a general drawing of the electrolytic cell used in Example 1.

While a specific embodiment of this invention has been illustrated in the accompanying drawings and described above, it will be apparent to those skilled in the art that changes and modifications may be made therein without departing from the essence of this invention, as set forth in the appended claims.

I claim:

1. A method of coalescing bubbles produced at an electrode in an electrolytic process in which electrodes consisting of at least one anode and at least one cathode are adjacent but spaced from one another, and are substantially immersed in the electrolyte, the method comprising:

affixing to at least one electrode a surface-limiting electrically inert masking means of which at least the bottom portion is submerged in the electrolyte, the masking means extending over the whole upper portion of said one electrode and projecting above the surface of said electrolyte, thus reducing the free surface of the electrolyte between the electrodes, and passing current between the electrodes, thus generating gas bubbles at at least one electrode, the gas bubbles being urged together by the masking means and coalescing.

2. The method claimed in claim 1, in which the masking means includes a lower surface which is oblique to the vertical.

3. The method claimed in claim 1, in which both the cathode and the anode have masking means affixed thereto.

4. An electrolysis apparatus in which bubbles of gas produced at an electrode immersed in an electrolyte may be coalesced in order to reduce acid mist generation, the apparatus including electrodes consisting of at least one anode and at least one cathode which are adjacent but spaced from one another, and are substantially immersed in the electrolyte, at least one electrode having affixed thereto a surface-limiting, electrically inert masking means of which at least the bottom portion is submerged in the electrolyte, the masking means extending over the whole upper portion of said one electrode and projecting above the surface of said electrolyte, thus reducing the free surface of the electrolyte between the electrodes, thus urging gas bubbles generated at one of the electrode to coalesce together.

5. The apparatus claimed in claim 4, in which the masking means includes a lower surface which is oblique to the vertical.

6. The apparatus claimed in claim 4, in which both the cathode and the anode have masking means affixed thereto.

* * * * *